US011011855B2

(12) United States Patent
Huang

(10) Patent No.: US 11,011,855 B2
(45) Date of Patent: May 18, 2021

(54) ANTENNA SYSTEM

(71) Applicant: Wistron NeWeb Corp., Hsinchu (TW)

(72) Inventor: Chun-Lin Huang, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 64 days.

(21) Appl. No.: 16/700,041

(22) Filed: Dec. 2, 2019

(65) Prior Publication Data

US 2021/0021054 A1 Jan. 21, 2021

(30) Foreign Application Priority Data

Jul. 16, 2019 (TW) ..... 108125019

(51) Int. Cl.

| | |
|---|---|
| ***H01Q 21/26*** | (2006.01) |
| ***H01Q 9/16*** | (2006.01) |
| *H01Q 1/38* | (2006.01) |
| *H01Q 25/00* | (2006.01) |
| *H01Q 1/48* | (2006.01) |
| *H01Q 1/24* | (2006.01) |
| *H01Q 5/307* | (2015.01) |
| *H01Q 9/28* | (2006.01) |

(52) U.S. Cl.

CPC ..... *H01Q 21/26* (2013.01); *H01Q 9/16* (2013.01); *H01Q 1/243* (2013.01); *H01Q 1/38* (2013.01); *H01Q 1/48* (2013.01); *H01Q 5/307* (2015.01); *H01Q 9/28* (2013.01); *H01Q 25/001* (2013.01)

(58) Field of Classification Search

CPC ..... H01Q 21/26; H01Q 1/38; H01Q 1/48; H01Q 1/243; H01Q 5/307; H01Q 9/28; H01Q 25/001

USPC ..... 343/797, 795, 793, 810, 803, 700 MS

See application file for complete search history.

(56) References Cited

U.S. PATENT DOCUMENTS

2004/0001027 A1* 1/2004 Killen ..... H01Q 7/00 343/795

FOREIGN PATENT DOCUMENTS

| | | |
|---|---|---|
| CN | 2479654 Y | 2/2002 |
| TW | M427688 U | 4/2012 |

* cited by examiner

*Primary Examiner* — Joseph J Lauture

(74) *Attorney, Agent, or Firm* — McClure, Qualey & Rodack, LLP

(57) ABSTRACT

An antenna system includes a dielectric substrate, a first dipole antenna element, a second dipole antenna element, a first additional metal element, a second additional metal element, first conductive via elements, and second conductive via elements. The first dipole antenna element and the first additional metal element are disposed on a first surface of the dielectric substrate. The first dipole antenna element includes a first radiation element and a second radiation element. The second dipole antenna element and the second additional metal element are disposed on a second surface of the dielectric substrate. The second dipole antenna element includes a third radiation element and a fourth radiation element. The first additional metal element is coupled through the first conductive via elements to the third radiation element. The second additional metal element is coupled through the second conductive via elements to the first radiation element.

20 Claims, 7 Drawing Sheets

ANTENNA SYSTEM

CROSS REFERENCE TO RELATED APPLICATIONS

This application claims priority of Taiwan Patent Application No. 108125019 filed on Jul. 16, 2019, the entirety of which is incorporated by reference herein.

BACKGROUND OF THE INVENTION

Field of the Invention

The disclosure generally relates to an antenna system, and more particularly, to an antenna system with high isolation.

Description of the Related Art

With the advances being made in mobile communication technology, mobile devices such as portable computers, mobile phones, multimedia players, and other hybrid functional portable electronic devices have become more common. To satisfy consumer demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

An antenna for wireless communication is an indispensable component in the mobile device. With current designs, multiple antennas are often placed into the mobile device for signal reception and transmission. However, if the antennas have operation frequencies that are the same or similar, they will tend to interfere with each other, thereby degrading the communication quality of the mobile device. As a result, there is a need to propose a novel solution for solving the problem of the prior art.

BRIEF SUMMARY OF THE INVENTION

In an exemplary embodiment, the invention is directed to an antenna system which includes a dielectric substrate, a first dipole antenna element, a second dipole antenna element, one or more first conductive via elements, a first additional metal element, one or more second conductive via elements, and a second additional metal element. The dielectric substrate has a first surface and a second surface which are opposite to each other. The first dipole antenna element is disposed on the first surface of the dielectric substrate. The first dipole antenna element includes a first radiation element and a second radiation element. The first radiation element has a first notch. The second radiation element includes a first protruding portion extending into the first notch. The second dipole antenna element is disposed on the second surface of the dielectric substrate. The second dipole antenna element includes a third radiation element and a fourth radiation element. The third radiation element has a second notch. The fourth radiation element includes a second protruding portion extending into the second notch. The first conductive via elements penetrate the dielectric substrate. The first additional metal element is disposed on the first surface of the dielectric substrate. The first additional metal element is coupled through the first conductive via elements to the third radiation element. The second conductive via elements penetrate the dielectric substrate. The second additional metal element is disposed on the second surface of the dielectric substrate. The second additional metal element is coupled through the second conductive via elements to the first radiation element.

In some embodiments, the first dipole antenna element and the second dipole antenna element are substantially perpendicular to each other.

In some embodiments, both the first dipole antenna element and the second dipole antenna element cover an operation frequency band from 5150 MHz to 7125 MHz.

In some embodiments, the length of each of the first dipole antenna element and the second dipole antenna element is from 0.4 to 0.6 wavelength of the operation frequency band.

In some embodiments, a first positive feeding point is positioned at the first protruding portion of the second radiation element, and a first negative feeding point is positioned at the second additional metal element.

In some embodiments, the antenna system further includes a first signal source and a first coaxial cable. The first signal source has a positive electrode and a negative electrode. The first coaxial cable includes a first central conductive line and a first conductive housing. The positive electrode of the first signal source is coupled through the first central conductive line to the first positive feeding point. The negative electrode of the first signal source is coupled through the first conductive housing to the first negative feeding point.

In some embodiments, a second positive feeding point is positioned at the first additional metal element, and a second negative feeding point is positioned at the second protruding portion of the fourth radiation element.

In some embodiments, the antenna system further includes a second signal source and a second coaxial cable. The second signal source has a positive electrode and a negative electrode. The second coaxial cable includes a second central conductive line and a second conductive housing. The positive electrode of the second signal source is coupled through the second central conductive line to the second positive feeding point. The negative electrode of the second signal source is coupled through the second conductive housing to the second negative feeding point.

In some embodiments, the first protruding portion of the second radiation element substantially has a relatively small rectangular shape, and the first notch of the first radiation element substantially has a relatively large rectangular shape.

In some embodiments, the second protruding portion of the fourth radiation element substantially has a relatively small circular shape, and the second notch of the third radiation element substantially has a relatively large circular shape.

In some embodiments, the first radiation element includes a first decoupling portion and a second decoupling portion which are adjacent to the first notch. The third radiation element includes a third decoupling portion and a fourth decoupling portion which are adjacent to the second notch.

In some embodiments, each of the first decoupling portion and the second decoupling portion substantially has a straight-line shape.

In some embodiments, each of the third decoupling portion and the fourth decoupling portion substantially has a smooth arc shape.

In some embodiments, the length of each of the first decoupling portion, the second decoupling portion, the third decoupling portion, and the fourth decoupling portion is from 0.03 to 0.06 wavelength of the operation frequency band.

In some embodiments, both the first decoupling portion and the second decoupling portion extend toward the central axis of the second dipole antenna element. The width of each of the first decoupling portion and the second decoupling portion is shorter than 0.5 mm.

In some embodiments, the distance between the first protruding portion and the first decoupling portion or the second decoupling portion is from 0.2 mm to 0.5 mm.

In some embodiments, both the third decoupling portion and the fourth decoupling portion extend toward the central axis of the first dipole antenna element. The width of each of the third decoupling portion and the fourth decoupling portion is shorter than 0.5 mm.

In some embodiments, the distance between the second protruding portion and the third decoupling portion or the fourth decoupling portion is from 0.2 mm to 0.5 mm.

In another exemplary embodiment, the invention is directed to an antenna system which includes a dielectric substrate, a first dipole antenna element, and a second dipole antenna element. The dielectric substrate has a first surface and a second surface which are opposite to each other. The first dipole antenna element is disposed on the first surface of the dielectric substrate. The first dipole antenna element includes a first radiation element and a second radiation element. The first radiation element has a first notch. The second radiation element includes a first protruding portion extending into the first notch. The second dipole antenna element is disposed on the second surface of the dielectric substrate. The second dipole antenna element includes a third radiation element and a fourth radiation element. The third radiation element has a second notch. The fourth radiation element includes a second protruding portion extending into the second notch. The first dipole antenna element and the second dipole antenna element are substantially perpendicular to each other.

In some embodiments, a first positive feeding point is positioned at the first protruding portion of the second radiation element, a first negative feeding point is positioned at the first radiation element, a second positive feeding point is positioned at the third radiation element, and a second negative feeding point is positioned at the second protruding portion of the fourth radiation element.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail below.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
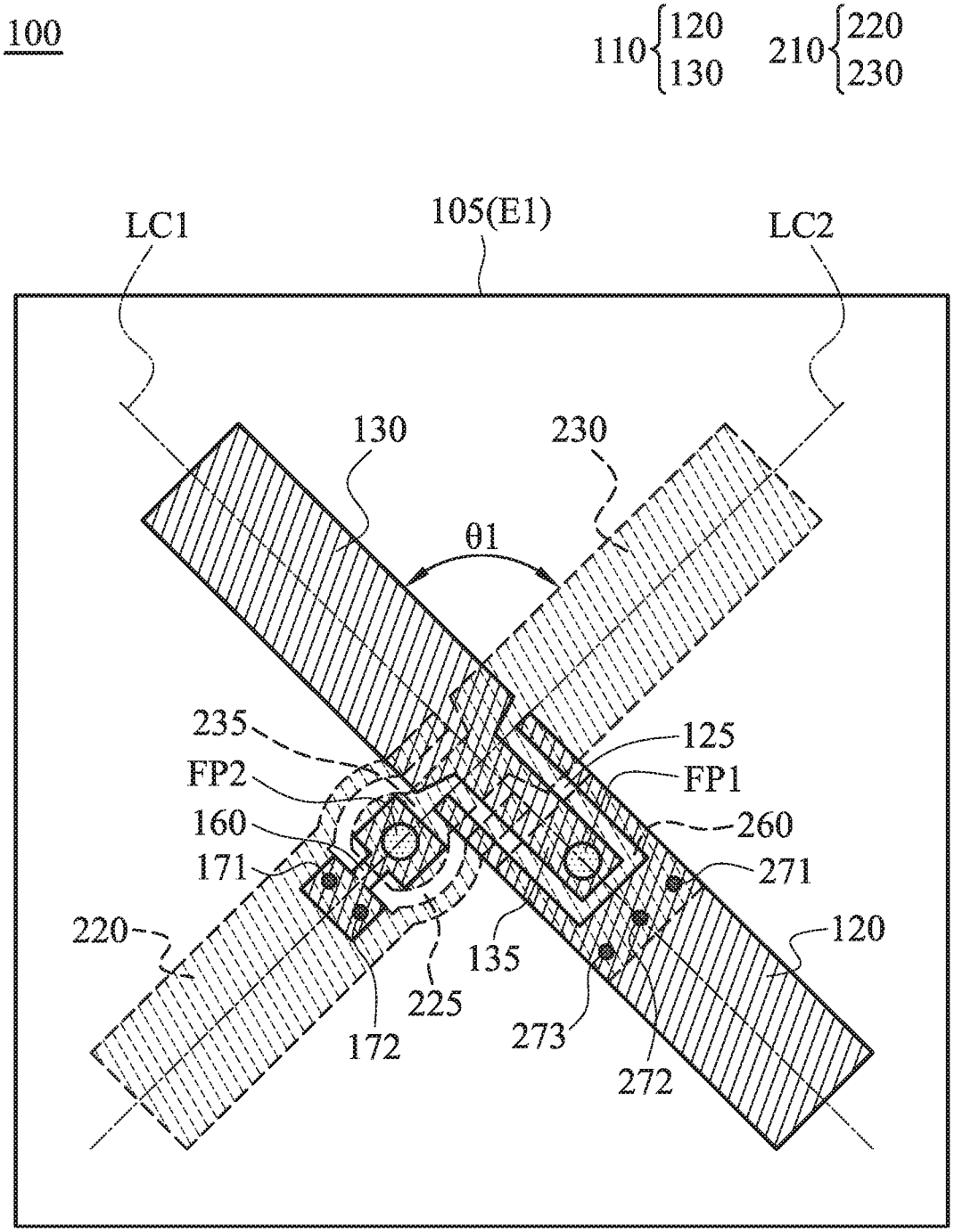
FIG. 1A is a top view of an antenna system according to an embodiment of the invention.
Figure 1B:
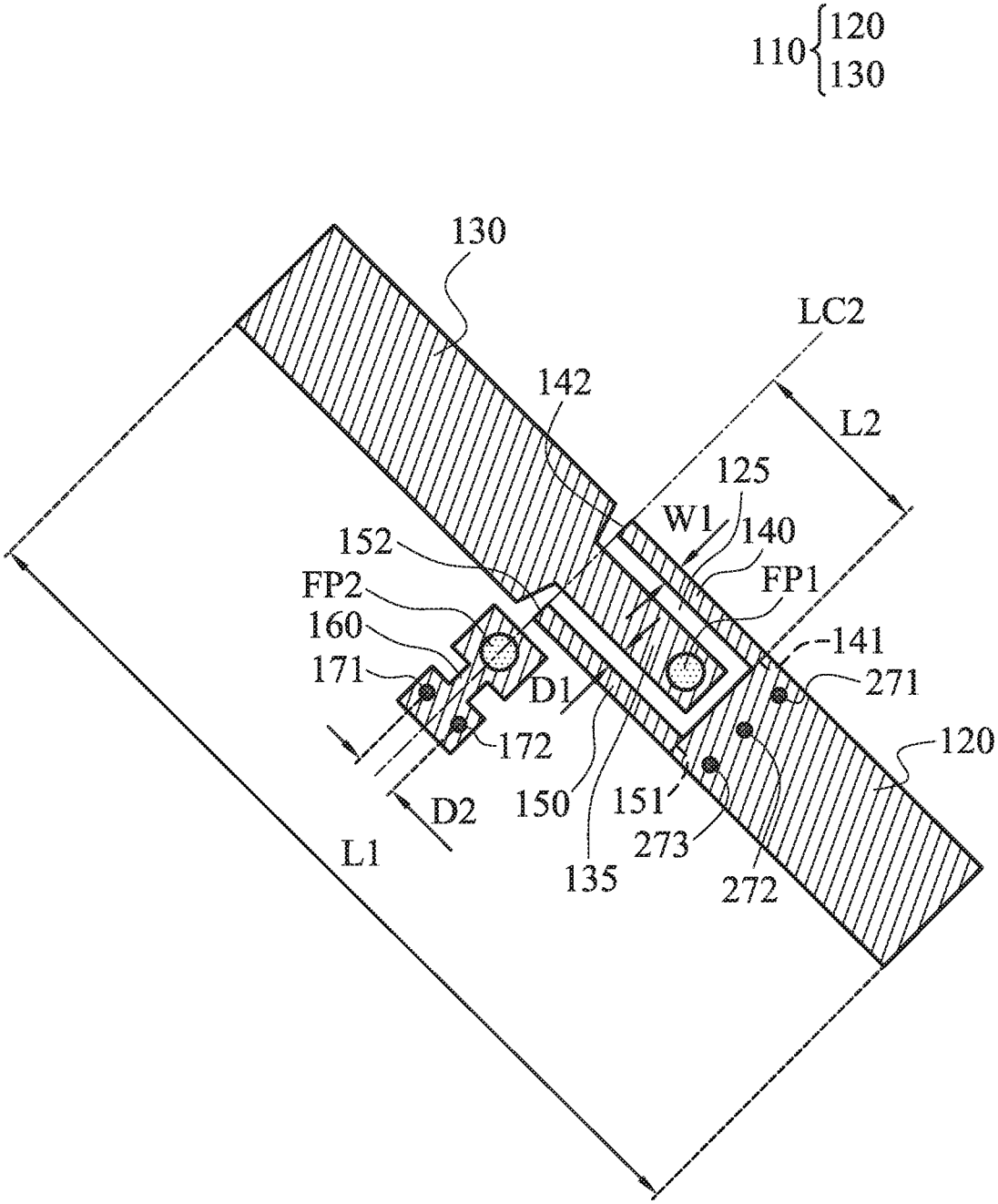
FIG. 1B is a view of an upper layer of an antenna system according to an embodiment of the invention.
Figure 1C:
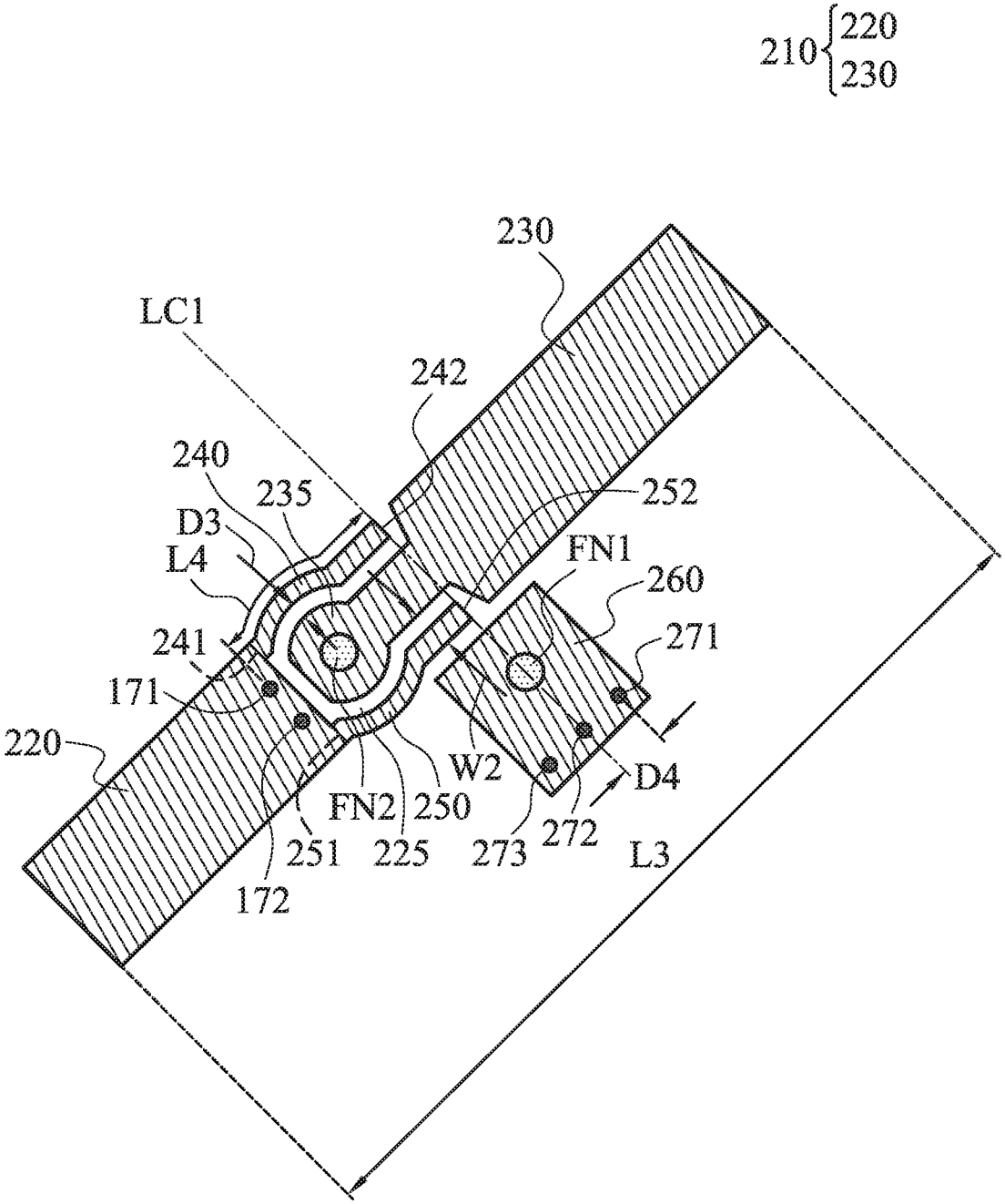
FIG. 1C is a view of a lower layer of an antenna system according to an embodiment of the invention.
Figure 1D:
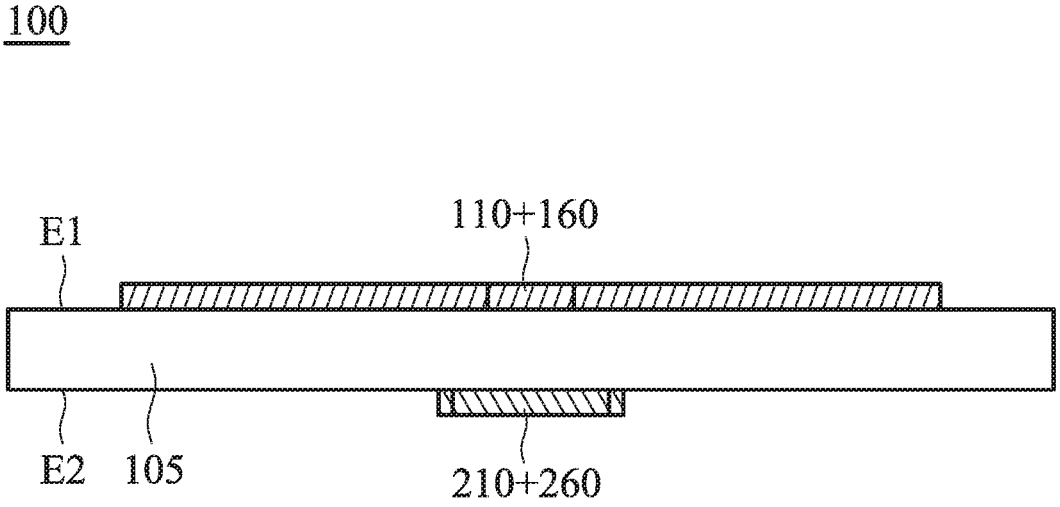
FIG. 1D is a side view of an antenna system according to an embodiment of the invention.

FIG. 1A is a top view of an antenna system 100 according to an embodiment of the invention. The antenna system 100 may be integrated with a dielectric substrate 105. The dielectric substrate 105 has a first surface E1 and a second surface E2 which are opposite to each other. For example, the dielectric substrate 105 may be an FR4 (Flame Retardant 4) substrate, a PCB (Printed Circuit Board), or an FCB (Flexible Circuit Board). FIG. 1B is a view of an upper layer of the antenna system 100 according to an embodiment of the invention, that is, a partial antenna pattern disposed on the first surface E1 of the dielectric substrate 105 is displayed. FIG. 1C is a view of a lower layer of the antenna system 100 according to an embodiment of the invention, that is, another partial antenna pattern disposed on the second surface E2 of the dielectric substrate 105 is displayed. FIG. 1A is a combination of FIG. 1B and FIG. 1C. It should be noted that FIG. 1C is a see-through view of the lower layer of the antenna pattern, instead of the back view of FIG. 1A (the difference between the see-through view and the back view is a 180-degree flip therebetween). FIG. 1D is a side view of the antenna system 100 according to an embodiment of the invention. Please refer to FIG. 1A, FIG. 1B, FIG. 1C, and FIG. 1D together. The antenna system 100 may be applied to a wireless access point or a mobile device, such as a smart phone, a tablet computer, or a notebook computer. In the embodiment of FIG. 1A, FIG. 1B, FIG. 1C, and FIG. 1D, the antenna system 100 includes a dielectric substrate 105, a first dipole antenna element 110, a first additional metal element 160, one or more first conductive via elements 171 and 172, a second dipole antenna element 210, a second additional metal element 260, and one or more second conductive via elements 271, 272 and 273. The first dipole antenna element 120 and the second dipole antenna element 210 may be substantially perpendicular to each other.

As shown in FIG. 1B, the first dipole antenna element 110 is disposed on the first surface E1 of the dielectric substrate 105. The first dipole antenna element 110 may substantially have a straight-line shape. The first dipole antenna element 110 includes a first radiation element 120 and a second radiation element 130. The first radiation element 120 has a first notch 125. The second radiation element 130 includes a first protruding portion 135 extending into the first notch 125. For example, the first protruding portion 135 of the second radiation element 130 may substantially have a relatively small rectangular shape, and the first notch 125 of the first radiation element 120 may substantially have a relatively large rectangular shape for accommodating the first protruding portion 135, but they are not limited thereto. It should be noted that the first protruding portion 135 of the second radiation element 130 does not directly touch any portion of the first radiation element 120.

In some embodiments, the first radiation element 120 includes a first decoupling portion 140 and a second decoupling portion 150 which are adjacent to the first notch 125. The first protruding portion 135 of the second radiation element 130 is positioned between the first decoupling portion 140 and the second decoupling portion 150. Each of the first decoupling portion 140 and the second decoupling portion 150 may substantially have a straight-line shape. The first decoupling portion 140 and the second decoupling portion 150 may be substantially parallel to each other. The first decoupling portion 140 has a first end 141 and a second end 142. The first end 141 of the first decoupling portion 140 is coupled to a body of the first radiation element 120 (i.e., a main rectangular portion of the first radiation element 120). The second end 142 of the first decoupling portion 140 is an open end extending toward a central axis LC2 of the second dipole antenna element 210. As will be appreciated by persons skilled in the art, the terminal portion of second end 142 can vary, consistent with the scope and spirit of the present invention. That is, in some embodiments, the second end 142 may be at the central axis LC2 (as illustrated in FIG. 1B). In other embodiments, the second end 142 may extend past the central axis LC2 (i.e., the length L2 is longer than that illustrated in FIG. 1B), while in other embodiments, the second end 142 may not reach the central axis LC2 (i.e., the length L2 is shorter than that illustrated in FIG. 1B). The second decoupling portion 150 has a first end 151 and a second end 152. The first end 151 of the second decoupling portion 150 is coupled to the body of the first radiation element 120. The second end 152 of the second decoupling portion 150 is an open end extending toward the central axis LC2 of the second dipole antenna element 210. As will be appreciated by persons skilled in the art, the terminal portion of second end 152 can vary, consistent with the scope and spirit of the present invention. That is, in some embodiments, the second end 152 may be at the central axis LC2 (as illustrated in FIG. 1B). In other embodiments, the second end 152 may extend past the central axis LC2 (i.e., the length L2 is longer than that illustrated in FIG. 1B), while in other embodiments, the second end 152 may not reach the central axis LC2 (i.e., the length L2 is shorter than that illustrated in FIG. 1B).

As shown in FIG. 1C, the second dipole antenna element 210 is disposed on the second surface E2 of the dielectric substrate 105. The second dipole antenna element 210 may substantially have a straight-line shape. The second dipole antenna element 210 includes a third radiation element 220 and a fourth radiation element 230. The third radiation element 220 has a second notch 225. The fourth radiation element 230 includes a second protruding portion 235 extending into the second notch 225. For example, the second protruding portion 235 of the fourth radiation element 230 may substantially have a relatively small circular shape, and the second notch 225 of the third radiation element 220 may substantially have a relatively large circular shape for accommodating the second protruding portion 235, but they are not limited thereto. It should be noted that the second protruding portion 235 of the fourth radiation element 230 does not directly touch any portion of the third radiation element 220.

In some embodiments, the third radiation element 220 includes a third decoupling portion 240 and a fourth decoupling portion 250 which are adjacent to the second notch 225. The second protruding portion 235 of the fourth radiation element 230 is positioned between the third decoupling portion 240 and the fourth decoupling portion 250. Each of the third decoupling portion 240 and the fourth decoupling portion 250 may substantially have a smooth arc shape. The third decoupling portion 240 has a first end 241 and a second end 242. The first end 241 of the third decoupling portion 240 is coupled to a body of the third radiation element 220 (i.e., a main rectangular portion of the third radiation element 220). The second end 242 of the third decoupling portion 240 is an open end extending toward a central axis LC1 of the first dipole antenna element 110. As will be appreciated by persons skilled in the art, the terminal portion of second end 242 can vary, consistent with the scope and spirit of the present invention. That is, in some embodiments, the second end 242 may be at the central axis LC1 (as illustrated in FIG. 1C). In other embodiments, the second end 242 may extend past the central axis LC1 (i.e., the length L4 is longer than that illustrated in FIG. 1C), while in other embodiments, the second end 242 may not reach the central axis LC1 (i.e., the length L4 is shorter than that illustrated in FIG. 1C). The fourth decoupling portion 250 has a first end 251 and a second end 252. The first end 251 of the fourth decoupling portion 250 is coupled to the body of the third radiation element 220. The second end 252 of the fourth decoupling portion 250 is an open end extending toward the central axis LC1 of the first dipole antenna element 110. As will be appreciated by persons skilled in the art, the terminal portion of second end 252 can vary, consistent with the scope and spirit of the present invention. That is, in some embodiments, the second end 252 may be at the central axis LC1 (as illustrated in FIG. 1C). In other embodiments, the second end 252 may extend past the central axis LC1 (i.e., the length L4 is longer than that illustrated in FIG. 1C), while in other embodiments, the second end 252 may not reach the central axis LC1 (i.e., the length L4 is shorter than that illustrated in FIG. 1C).

Both the first dipole antenna element 110 and the second dipole antenna element 210 can cover the same operation frequency band. According to practical measurements, the above first decoupling portion 140, second decoupling portion 150, third decoupling portion 240, and fourth decoupling portion 250 can significantly suppress the mutual coupling effect between the first dipole antenna element 110 and the second dipole antenna element 210 operating in the operation frequency band, thereby increasing the isolation between the first dipole antenna element 110 and the second dipole antenna element 210.

The first additional metal element 160 is disposed on the first surface E1 of the dielectric substrate 105 and is adjacent to the first dipole antenna element 110. The first additional metal element 160 may substantially have an H-shape. The first conductive via elements 171 and 172 penetrate the dielectric substrate 105. The first conductive via elements 171 and 172 are connected between the first surface E1 and the second surface E2 of the dielectric substrate 105. The first additional metal element 160 is coupled through the first conductive via elements 171 and 172 to the body of the third radiation element 220. The second additional metal element 260 is disposed on the second surface E2 of the dielectric substrate 105 and is adjacent to the second dipole antenna element 210. The second additional metal element 260 may substantially have a rectangular shape or a pentagonal shape. The second conductive via elements 271, 272 and 273 penetrate the dielectric substrate 105. The second conductive via elements 271, 272 and 273 are connected between the first surface E1 and the second surface E2 of the dielectric substrate 105. The second additional metal element 260 is coupled through the second conductive via elements 271, 272 and 273 to the body of the first radiation element 120. The number of first conductive via elements 171 and 172 and the number of second conductive via elements 271, 272 and 273 are not limited in the invention. It should be noted that the term "adjacent" or "close" over the disclosure means that the distance (spacing) between two corresponding elements is smaller than a predetermined distance (e.g., 10 mm or the shorter), but usually does not mean that the two corresponding elements directly touch each other (i.e., the aforementioned distance/spacing therebetween is reduced to 0).

In some embodiments, a first positive feeding point FP1 is positioned at the first protruding portion 135 of the second radiation element 130, and a first negative feeding point FN1 is positioned at the second additional metal element 260. A positive electrode of a first signal source (not shown) is coupled to the first positive feeding point FP1, and a negative electrode of the first signal source is coupled to the first negative feeding point FN1, so as to excite the first dipole antenna element 110. In some embodiments, a second positive feeding point FP2 is positioned at the first additional metal element 160, and a second negative feeding point FN2 is positioned at the second protruding portion 235 of the fourth radiation element 230. A positive electrode of a second signal source (not shown) is coupled to the second positive feeding point FP2, and a negative electrode of the second signal source is coupled to the second negative feeding point FN2, so as to excite the second dipole antenna element 210.

Figure 2:
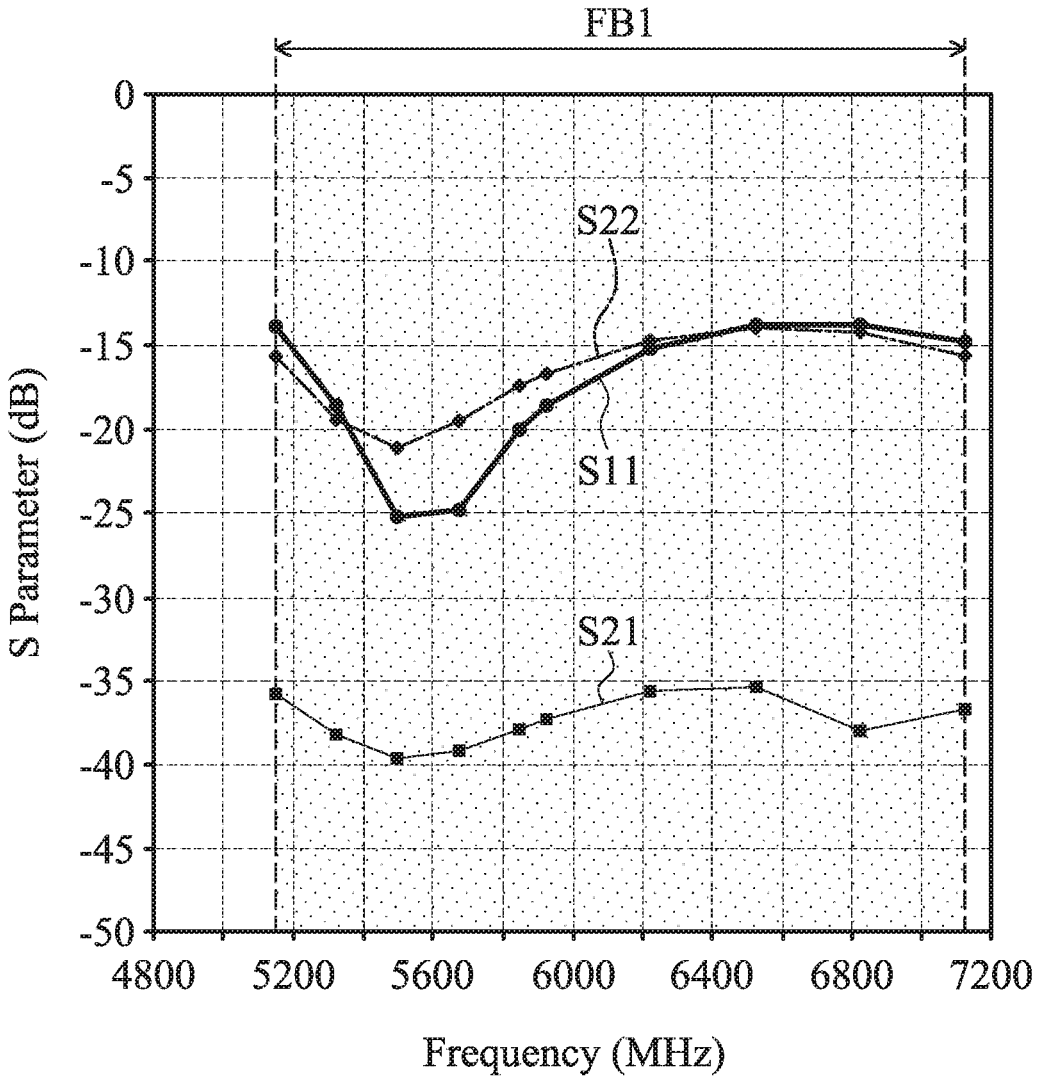
FIG. 2 is a diagram of S-parameters of an antenna system according to an embodiment of the invention.

FIG. 2 is a diagram of S-parameters of the antenna system 100 according to an embodiment of the invention. The horizontal axis represents the operation frequency (MHz), and the vertical axis represents the S-parameter (dB). The first positive feeding point FP1 is defined as a first port (Port 1). The second positive feeding point FP2 is defined as a second port (Port 2). The S11-parameter, S22-parameter, and S21-parameter between the first port and the second port may be described as follows. According to the S11-parameter curve and the S22-parameter curve of FIG. 2, both the first dipole antenna element 110 and the second dipole antenna element 210 can cover an operation frequency band FB1 from 5150 MHz to 7125 MHz, and therefore the antenna system 100 can support at least the wideband operation of new generation Wi-Fi. According to the S21-parameter curve of FIG. 2, within the operation frequency band FB1, the isolation between the first dipole antenna element 110 and the second dipole antenna element 210 can reach 35 dB or higher, and it can meet the requirement of practical application of general antenna systems.

In some embodiments, the element sizes of the antenna system 100 are described as follows. The angle θ1 between the first dipole antenna element 110 and the second dipole antenna element 210 may be from 70 to 110 degrees, such as 90 degrees. The length L1 of the first dipole antenna element 110 may be from 0.4 to 0.6 wavelength (0.4λ~0.6λ) of the operation frequency band FB1 of the antenna system 100, such as about 0.5 wavelength (0.5λ). The length L2 of each of the first decoupling portion 140 and the second decoupling portion 150 may be from 0.03 to 0.06 wavelength (0.03λ~0.06λ) of the operation frequency band FB1 of the antenna system 100. The width W1 of each of the first decoupling portion 140 and the second decoupling portion 150 may be shorter than 0.5 mm. The distance D1 between the first protruding portion 135 and the first decoupling portion 140 or the second decoupling portion 150 may be from 0.2 mm to 0.5 mm, such as about 0.5 mm. The distance D2 between the first conductive via elements 171 and 172 may be shorter than or equal to 1 mm. The length L3 of the second dipole antenna element 210 may be from 0.4 to 0.6 wavelength (0.4λ~0.6λ) of the operation frequency band FB1 of the antenna system 100, such as about 0.5 wavelength (0.5λ). The length L4 of each of the third decoupling portion 240 and the fourth decoupling portion 250 may be from 0.03 to 0.06 wavelength (0.03λ~0.06λ) of the operation frequency band FB1 of the antenna system 100. The width W2 of each of the third decoupling portion 240 and the fourth decoupling portion 250 may be shorter than 0.5 mm. The distance D3 between the second protruding portion 235 and the third decoupling portion 240 or the fourth decoupling portion 250 may be from 0.2 mm to 0.5 mm, such as about 0.5 mm. The distance D4 between any adjacent two of the second conductive via elements 271, 272 and 273 may be shorter than or equal to 1 mm. The above ranges of element sizes are calculated and obtained according to many experiment results, and they help to optimize the operation bandwidth, isolation and impedance matching of the antenna system 100.

Figure 3:
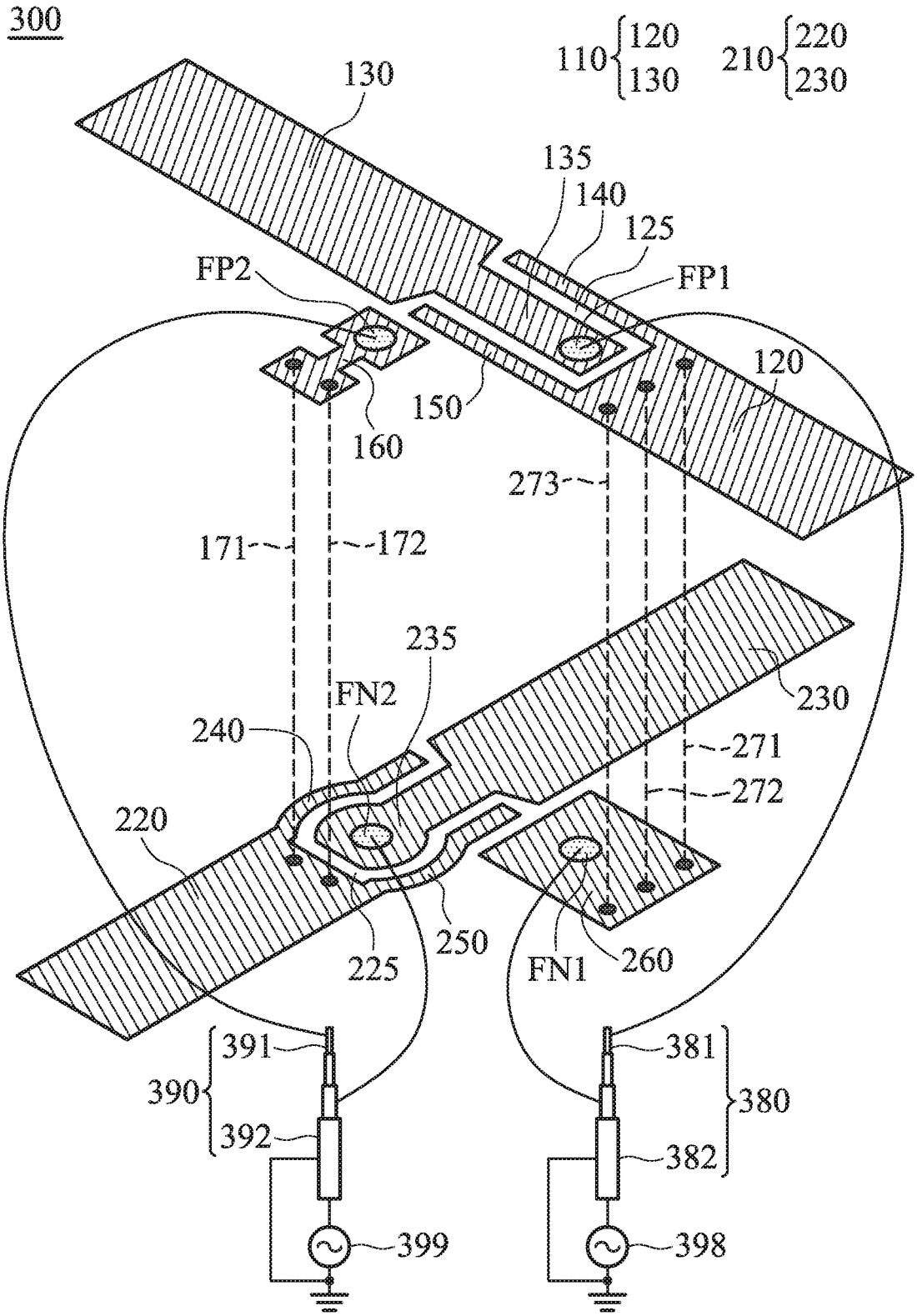
FIG. 3 is an exploded top view of an antenna system according to an embodiment of the invention.

FIG. 3 is an exploded top view of an antenna system 300 according to an embodiment of the invention. FIG. 3 is similar to FIG. 1A, FIG. 1B, FIG. 1C and FIG. 1D, but the aforementioned dielectric substrate 105 is not displayed in FIG. 3. In the embodiment of FIG. 3, the antenna system 300 further includes a first coaxial cable 380, a second coaxial cable 390, a first signal source 398, and a second signal source 399. The first signal source 398 has a positive electrode and a negative electrode. The first coaxial cable 380 includes a first central conductive line 381 and a first conductive housing 382. The positive electrode of the first signal source 398 is coupled through the first central conductive line 381 to the first positive feeding point FP1 of the antenna system 300. The negative electrode of the first signal source 398 is coupled through the first conductive housing 382 to the first negative feeding point FN1 of the antenna system 300. For example, the second additional metal element 260 may have a first opening. The first central conductive line 381 may pass through the first opening and may be soldered to the first protruding portion 135 of the second radiation element 130. The first conductive housing 382 may be soldered to an edge metal portion of the first opening. The second signal source 399 has a positive electrode and a negative electrode. The second coaxial cable 390 includes a second central conductive line 391 and a second conductive housing 392. The positive electrode of the second signal source 399 is coupled through the second central conductive line 391 to the second positive feeding point FP2 of the antenna system 300. The negative electrode of the second signal source 399 is coupled through the second conductive housing 392 to the second negative feeding point FN2 of the antenna system 300. For example, the second protruding portion 235 of the fourth radiation element 230 may have a second opening. The second central conductive line 391 may pass through the second opening and may be soldered to the first additional metal element 160. The second conductive housing 392 may be soldered to an edge metal portion of the second opening. Such a dual-crossing-feeding mechanism, using the additional metal elements and conductive via elements, can simplify the manufacturing process of the antenna system 300, thereby reducing the manufacturing cost of the antenna system 300. Other features of the antenna system 300 of FIG. 3 are similar to those of the antenna system 100 of FIG. 1A, FIG. 1B, FIG. 1C, and FIG. 1D. Accordingly, the two embodiments can achieve similar levels of performance.

Figure 4:
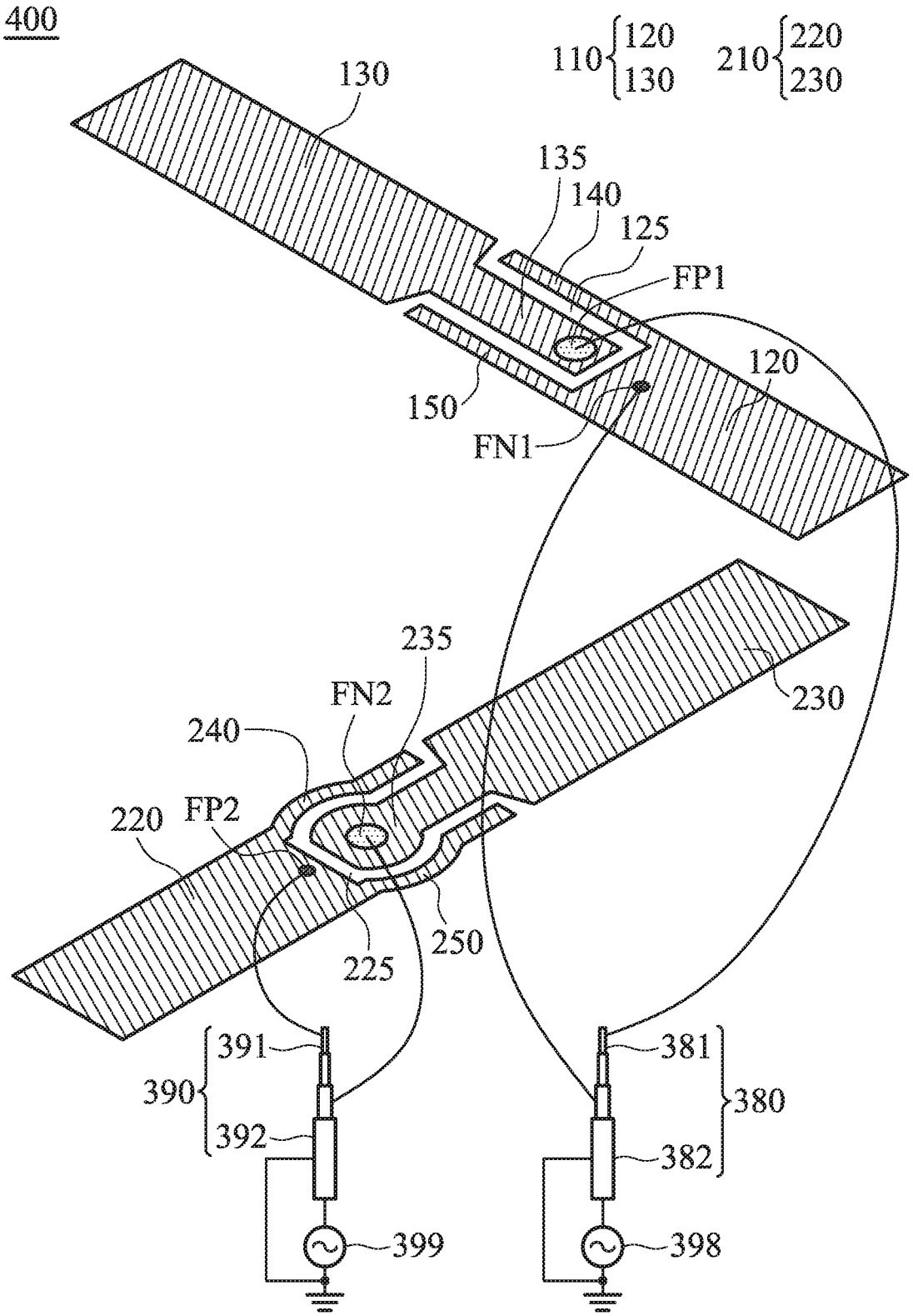
FIG. 4 is an exploded top view of an antenna system according to another embodiment of the invention.

FIG. 4 is an exploded top view of an antenna system 400 according to another embodiment of the invention. FIG. 4 is similar to FIG. 3. In the embodiment of FIG. 4, the antenna system 400 merely includes the dielectric substrate (not shown), the first dipole antenna element 110, and the second dipole antenna element 210; however, the antenna system 400 does not include the first additional metal element 160, the second additional metal element 260, the first conductive via elements 171 and 172, and the second conductive via elements 271, 272 and 273 as described above. The first positive feeding point FP1 is positioned at the first protruding portion 135 of the second radiation element 130. The first negative feeding point FN1 is positioned at the first radiation element 120. The second positive feeding point FP2 is positioned at the third radiation element 220. The second negative feeding point FN2 is positioned at the second protruding portion 235 of the fourth radiation element 230. Such a design, omitting the additional metal elements and conductive via elements, can provide an alternative feeding mechanism, so as to meet different requirements of communication. Other features of the antenna system 400 of FIG. 4 are similar to those of the antenna system 300 of FIG. 3. Accordingly, the two embodiments can achieve similar levels of performance.

The invention proposes a novel antenna system for integrating two dipole antenna elements with the same dielectric substrate. Generally, the invention has at least the advantages of small size, wide bandwidth, high isolation, low manufacturing cost, and almost omnidirectional radiation pattern. Therefore, the invention is suitable for application in a variety of communication devices.

Note that the above element sizes, element shapes, and frequency ranges are not limitations of the invention. An antenna designer can fine-tune these settings or values according to different requirements. It should be understood that the antenna system of the invention is not limited to the configurations of FIGS. 1-4. The invention may merely include any one or more features of any one or more embodiments of FIGS. 1-4. In other words, not all of the features displayed in the figures should be implemented in the antenna system of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna system, comprising:

a dielectric substrate, having a first surface and a second surface opposite to each other;

a first dipole antenna element, disposed on the first surface of the dielectric substrate, wherein the first dipole antenna element comprises a first radiation element and a second radiation element, the first radiation element has a first notch, and the second radiation element comprises a first protruding portion extending into the first notch;

a second dipole antenna element, disposed on the second surface of the dielectric substrate, wherein the second dipole antenna element comprises a third radiation element and a fourth radiation element, the third radiation element has a second notch, and the fourth radiation element comprises a second protruding portion extending into the second notch;

one or more first conductive via elements, penetrating the dielectric substrate;

a first additional metal element, disposed on the first surface of the dielectric substrate, wherein the first additional metal element is coupled through the first conductive via elements to the third radiation element;

one or more second conductive via elements, penetrating the dielectric substrate; and a second additional metal element, disposed on the second surface of the dielectric substrate, wherein the second additional metal element is coupled through the second conductive via elements to the first radiation element.

2. The antenna system as claimed in claim 1, wherein the first dipole antenna element and the second dipole antenna element are substantially perpendicular to each other.

3. The antenna system as claimed in claim 1, wherein both the first dipole antenna element and the second dipole antenna element cover an operation frequency band from 5150 MHz to 7125 MHz.

4. The antenna system as claimed in claim 3, wherein a length of each of the first dipole antenna element and the second dipole antenna element is from 0.4 to 0.6 wavelength of the operation frequency band.

5. The antenna system as claimed in claim 3, wherein the first radiation element comprises a first decoupling portion and a second decoupling portion adjacent to the first notch, and the third radiation element comprises a third decoupling portion and a fourth decoupling portion adjacent to the second notch.

6. The antenna system as claimed in claim 5, wherein each of the first decoupling portion and the second decoupling portion substantially has a straight-line shape.

7. The antenna system as claimed in claim 5, wherein each of the third decoupling portion and the fourth decoupling portion substantially has a smooth arc shape.

8. The antenna system as claimed in claim 5, wherein a length of each of the first decoupling portion, the second decoupling portion, the third decoupling portion, and the fourth decoupling portion is from 0.03 to 0.06 wavelength of the operation frequency band.

9. The antenna system as claimed in claim 5, wherein both the first decoupling portion and the second decoupling portion extend toward a central axis of the second dipole antenna element, and a width of each of the first decoupling portion and the second decoupling portion is shorter than 0.5 mm.

10. The antenna system as claimed in claim 5, wherein a distance between the first protruding portion and the first decoupling portion or the second decoupling portion is from 0.2 mm to 0.5 mm.

11. The antenna system as claimed in claim 5, wherein both the third decoupling portion and the fourth decoupling portion extend toward a central axis of the first dipole antenna element, and a width of each of the third decoupling portion and the fourth decoupling portion is shorter than 0.5 mm.

12. The antenna system as claimed in claim 5, wherein a distance between the second protruding portion and the third decoupling portion or the fourth decoupling portion is from 0.2 mm to 0.5 mm.

13. The antenna system as claimed in claim 1, wherein a first positive feeding point is positioned at the first protruding portion of the second radiation element, and a first negative feeding point is positioned at the second additional metal element.

14. The antenna system as claimed in claim 13, further comprising:

a first signal source, having a positive electrode and a negative electrode; and a first coaxial cable, comprising a first central conductive line and a first conductive housing, wherein the positive electrode of the first signal source is coupled through the first central conductive line to the first positive feeding point, and the negative electrode of the first signal source is coupled through the first conductive housing to the first negative feeding point.

15. The antenna system as claimed in claim 1, wherein a second positive feeding point is positioned at the first additional metal element, and a second negative feeding point is positioned at the second protruding portion of the fourth radiation element.

16. The antenna system as claimed in claim 15, further comprising:

a second signal source, having a positive electrode and a negative electrode; and a second coaxial cable, comprising a second central conductive line and a second conductive housing, wherein the positive electrode of the second signal source is coupled through the second central conductive line to the second positive feeding point, and the negative electrode of the second signal source is coupled through the second conductive housing to the second negative feeding point.

17. The antenna system as claimed in claim 1, wherein the first protruding portion of the second radiation element substantially has a relatively small rectangular shape, and the first notch of the first radiation element substantially has a relatively large rectangular shape.

18. The antenna system as claimed in claim 1, wherein the second protruding portion of the fourth radiation element substantially has a relatively small circular shape, and the second notch of the third radiation element substantially has a relatively large circular shape.

19. An antenna system, comprising:

a dielectric substrate, having a first surface and a second surface opposite to each other;

a first dipole antenna element, disposed on the first surface of the dielectric substrate, wherein the first dipole antenna element comprises a first radiation element and a second radiation element, the first radiation element has a first notch, and the second radiation element comprises a first protruding portion extending into the first notch; and a second dipole antenna element, disposed on the second surface of the dielectric substrate, wherein the second dipole antenna element comprises a third radiation element and a fourth radiation element, the third radiation element has a second notch, and the fourth radiation element comprises a second protruding portion extending into the second notch;

wherein the first dipole antenna element and the second dipole antenna element are substantially perpendicular to each other.

20. The antenna system as claimed in claim 19, wherein a first positive feeding point is positioned at the first protruding portion of the second radiation element, a first negative feeding point is positioned at the first radiation element, a second positive feeding point is positioned at the third radiation element, and a second negative feeding point is positioned at the second protruding portion of the fourth radiation element.

* * * * *